United States Patent [19]

Dawber et al.

[11] 4,428,089

[45] Jan. 31, 1984

[54] FOOTWEAR AND FORMING METHODS THEREFOR

[76] Inventors: Stanley R. K. Dawber, The Spinney, 1 Copperfield Rd., Cheadle Hulme, Cheshire; Duncan J. Fraser, 52 Westgate, Hale, Cheshire, both of England

[21] Appl. No.: 245,604

[22] Filed: Mar. 19, 1981

Related U.S. Application Data

[63] Continuation of Ser. No. 43,891, May 30, 1979, abandoned.

[30] Foreign Application Priority Data

May 31, 1978 [GB] United Kingdom ..... 25887/78

[51] Int. Cl.[3] ..... A43D 9/00; A43B 7/14

[52] U.S. Cl. ..... 12/142 R; 36/93

[58] Field of Search ..... 36/88, 93; 12/142 R, 12/142 P

[56] References Cited

U.S. PATENT DOCUMENTS

| | | | |
|---|---|---|---|
| 3,377,721 | 4/1968 | Johnson | 36/93 |
| 3,896,202 | 7/1975 | Palav | 36/93 |
| 4,120,064 | 10/1978 | Salomon | 12/142 R |

*Primary Examiner*—Patrick D. Lawson

*Attorney, Agent, or Firm*—Cushman, Darby & Cushman

[57] ABSTRACT

A method of forming an article of footwear to fit a predetermined foot is provided by modifying the shape of such an article in which the foot is readily engageable by in-situ formation of a resilient foam moulding in the free space between the article and foot. The moulding is preferably reinforced to resist abrasion during subsequent use, and this suitably involves the location of a woven or knitted resilient sock on the foot for impregnation by the moulding material. Also the moulding can bond spontaneously to the article. The moulding is preferably permeable, and need not fill the free space between the foot and article, but can be restricted by suitable location of inserts. The method is particularly suited to situations where the foot is abnormal.

3 Claims, 3 Drawing Figures

FOOTWEAR AND FORMING METHODS THEREFOR

Figure 1:
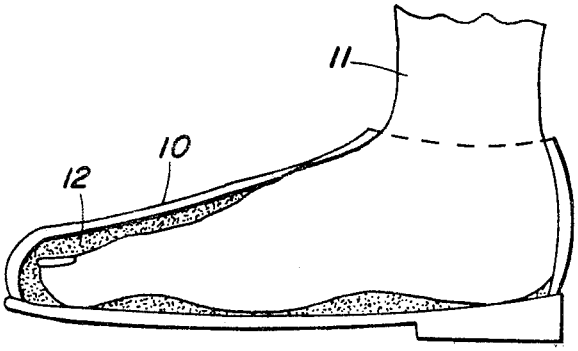

This is a continuation of application Ser. No. 43,891 filed May 30, 1979 now abandoned.

This invention concerns footwear and forming methods therefor, and more particularly, but not exclusively, footwear for users with pedal abnormalities.

Footwear of this particular kind is currently catered for in two generally different ways. More severe abnormalities commonly necessitate the provision of custom-made surgical boots and shoes and this is both time-consuming and costly by virtue of the involvement of skilled craftsmen. An added disadvantage of such footwear is that it is required to serve functional requirements to a greater extent than normal footwear and may, in consequence, be unsatisfactory from an aesthetic point of view. Less severe abnormalities can usually be dealt with by the addition of corrective attachments, and shoe-filling and support devices, located inside a normal shoe. Again disadvantage arises in cost because skilled personnel at chiropodial units and appliance clinics are normally involved, and it can take time to suit a shoe modification to a given user.

Accordingly, the present invention provides, in one aspect thereof, a method of forming an article of footwear to fit a predetermined foot, which method comprises modifying the shape of such an article in which said foot is readily engageable by forming in situ between said article and said foot a resilient foam moulding.

It will be appreciated from the above introductory discussion that in initial development of the proposed method the relevant foot has been anatomically abnormal. However, the method may be applied to the formation of footwear for normal users, in which event the relevant foot is a normal one, or a last or like foot-representing means. The practical benefit of this further application of the invention arises from the fact that a substantial proportion of a conventional footwear manufacturing operation could be rationalised to fewer sizes and width fittings than at present, with a final forming as proposed above being employed to cater for more specific fitting in the factory, at special fitting centres, or at retail outlets.

Preferably the moulding bonds spontaneously, during its formation, to the footwear article. However, it may in some circumstances be appropriate for the moulding to be separable from the article, such as for transfer to another such article.

The moulding is preferably permeable so that a user's foot can 'breathe' when the article is worn. This is particularly relevant when the moulding fills a substantial proportion or the whole of the free volume between the article and foot, but it will be appreciated that such filling is not implicit in application of the invention.

If the maximum free volume is not to be filled, it will normally be appropriate to locate inserts between the article and foot, prior to formation of the moulding, to constrain expansion of the moulding-forming foam to specific desired zones.

Also, it will normally be appropriate to protect the foot and/or any such inserts as just mentioned against bonding with the foam, and to facilitate release from the article after formation of the moulding. This can involve envelopment of the foot in an impermeable sock of close-fitting form and/or the use of a suitable release agent.

The proposed method also preferably comprises the mounting of reinforcement material on the foot for incorporation of such material into the moulding. This suitably involves location of a close-fitting woven or knitted sock of resilient material on the foot prior to formation of the moulding so that the moulding-forming foam impregnates and bonds to the sock when expanding to incorporate the sock into the surface region of the moulding adjacent to the foot. Such reinforcement serves to resist the wearing effects of abrasion on the moulding by a user's foot in use of the article, which effects are found to unduly shorten the useful life of a moulding made of foam material of which the physical properties are otherwise acceptable. In effect, the provision of the proposed reinforcement resolves a conflict which can otherwise be found to arise between the physical properties required of the moulding for the purposes of user comfort and desired foot support and the properties required for durability.

In development of the invention so far, use has been made of a foam forming system from ICI which produces a high quality, semi-flexible, low density polyurethane foam of high permeability to air and perspiration. The system in question involves a three part mix of Daltocel SF, which is a cross-linked polyester, Suprasec DN, which is a diphenylmethane diisocyanate composition (MDI) of low vapour pressure, and Activator HM10, which is a stable blend of catalysts, surfactants, foam stabilizers, polyols, and water. This system has been preferred because a wide range of properties can be produced by variation of the component proportions in the mix, and the system can be used safely with simple well-documented techniques developed from its use in other applications. In particular, stringent health hazard precautions, such as are necessary with systems involving tolylene diisocyanate (TDI), are unnecessary.

Also, during development, use has been made of a reinforcement sock of high-bulk 20 denier nylon yarn in a micromesh tubular knitted structure having approximately 4900 wales per meter, 4000 courses per meter, giving at least 100% free biaxial extension when stretched spontaneously in the wale and course directions, and weight of about 88 g/m$^2$.

In practice, the relevant system is preferably used in a mix which is somewhat deficient in the MDI component relative to formulations recommended by the manufacturer, suitably at an isocyanate index of around 50. This has been found to give satisfactory physical properties in the resultant foam mouldings, with the added advantage of complete utilisation of the available isocyanate in the reaction. Stable properties are achieved rapidly in the foam, with little exothermic heat build-up under the conditions of use, and the protected foot may be removed from the resultant moulding within four to five minutes following introduction of the mix.

The procedure used during this initial development of the invention has involved a preliminary step of filling the appropriate free volume between the article and foot with a suitable liquid or free-flowing particulate material and thereafter measuring the same volumetrically or gravitationally in order to determine the amount of foam-forming mix to be subsequently introduced. This allows avoidance of excess foam formation with possible overflow from the article and adhesion to the article exterior. Clearly, it also allows economy of material utilisation.

After this preliminary step: the mix is applied to the article; if appropriate the article is canted or the mix spread, while the mix is still liquid, to locate the mix in desired regions of the article; the foot, padded and supported as necessary, and covered with an impervious protective sock and then a foam-reinforcement sock, is then entered into the article; and the article is then closed. When the foam has formed and cured sufficiently, the foot is removed, the foam and reinforcement sock are cut and trimmed as necessary in the vicinity of the tongue and throat of the article, and the reinforcement sock is secured at the throat of the article by adhesive bonding, covering, or in other manner to prevent delamination in use.

Figure 2:
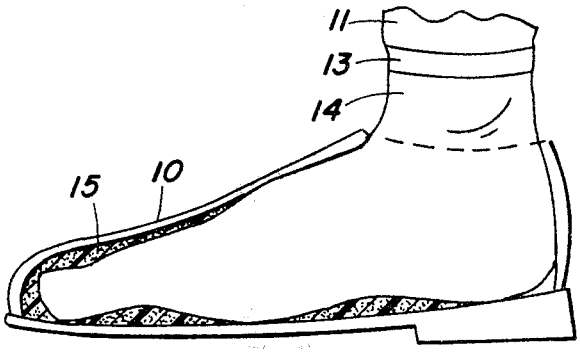
Figure 3:
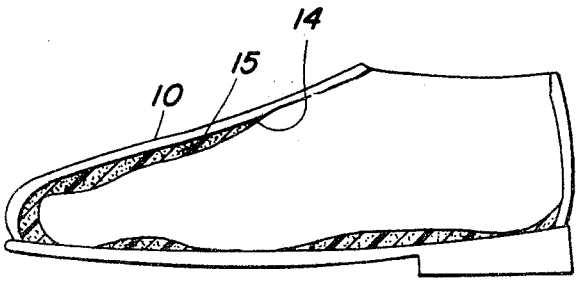

This procedure is schematically illustrated by FIGS. 1, 2 and 3 of the accompanying drawing showing successive principle stages therein.

In FIG. 1 a shoe 10 has a prospective user's foot 11 engaged therein and fluent material 12 added to fill the remanent free space. This material is removed thereafter and measured to determine the free space volume.

In FIG. 2 the foot 11 is first covered with a protective sock 13, then with a reinforcement sock 14, re-engaged in the shoe 10 and liquid added in appropriate quantity to form a foam moulding 15 just filling the free space.

In FIG. 3 the foot is removed and the socks are trimmed back to the shoe.

While the invention has been described with more particular reference to material used during initial development, variation is clearly possible. However, it may be appropriate to note that the foam structure is suitably, when of unreinforced free-rise slab form, of 120 to 135 kg/m$^3$ density, open-cell permeable form, with apparent indentation hardness of 140 to 185 (BS 3667(kg)) and 24 to 30 (BS 4443(N)), and that the reinforcement material is suitably of 50 den high bulk yarn knitted into a slight coarser structure than that mentioned above with a fabric weight of about 180 g/m$^2$.

We claim:

1. A method of forming an everyday article of footwear to fit an individual user's foot, which method comprises employing as said article one in which said foot is readily engageable, engaging said foot in said article, filling the free space between said foot and said article with fluent material, removing said foot from said article, removing said material from said article and measuring the former to determine the volume of said free space, covering said foot with a close-fitting first sock of impermeable release material, covering said foot and said first sock with a close-fitting second sock of resilient textile material, engaging the double sock covered foot in said article, and forming a moulding in said free space by dispensing thereinto a self-gassing expansible liquid which rapidly cures to a permeable open-cell foamed resilient solid, which is in a quantity determined to produce said solid substantially to equal said free space volume, which spontaneously bonds to said article, and which impregnates said second sock to be reinforced thereby but does not bond to said first sock.

2. A method according to claim 1 wherein said second sock is of knitted form.

3. A method according to claim 1 wherein said foot is medically abnormal.

* * * * *